US011326592B2

(12) United States Patent
Remmelmann et al.

(10) Patent No.: US 11,326,592 B2
(45) Date of Patent: May 10, 2022

(54) METHOD FOR OPERATING A HYDRAULIC CONSUMER ON AN ELECTRICALLY ACTUATED CONTROL VALVE

(71) Applicant: DEERE & COMPANY, Moline, IL (US)

(72) Inventors: Andreas Remmelmann, Karlstein (DE); Christian Brueser, Speyer (DE)

(73) Assignee: DEERE & COMPANY, Moline, IL (US)

( * ) Notice: Subject to any disclaimer, the term of this patent is extended or adjusted under 35 U.S.C. 154(b) by 276 days.

(21) Appl. No.: 16/515,932

(22) Filed: Jul. 18, 2019

(65) Prior Publication Data

US 2020/0025193 A1 Jan. 23, 2020

(30) Foreign Application Priority Data

Jul. 19, 2018 (DE) ..... 102018212077.3

(51) Int. Cl.
*F04B 49/08* (2006.01)
*F04B 1/295* (2020.01)
(Continued)

(52) U.S. Cl.
CPC ..... *F04B 49/08* (2013.01); *F04B 1/295* (2013.01); *F04B 1/324* (2013.01); *F04B 49/002* (2013.01);
(Continued)

(58) Field of Classification Search
CPC ..... F04B 1/295; F04B 1/324; F04B 49/002; F04B 49/03; F04B 49/06; F04B 49/065;
(Continued)

(56) References Cited

U.S. PATENT DOCUMENTS 4,801,247 A * 1/1989 Hashimoto ..... F04B 1/324 417/213
5,245,827 A * 9/1993 Durant ..... F15B 21/08 60/422
(Continued)

FOREIGN PATENT DOCUMENTS

WO 9210685 A1 6/1992

OTHER PUBLICATIONS

European Search Report issued in counterpart European Patent Application No. 19185918.0 dated Dec. 16, 2019 (5 pages).

*Primary Examiner* — Kenneth J Hansen

(57) ABSTRACT

A method for operating a hydraulic consumer on an electrically actuated control valve includes providing the valve with an open valve position for establishing a connection between a valve inlet and a pilot line for influencing a pivot angle set on an axial piston pump and a system pressure which is present at the valve inlet and dependent on the pivot angle. Data regarding the current system pressure and the current pivot angle are detected and communicated to a control unit. The method includes determining an incorrect setting of the control valve if the control unit detects that a delivery volume flow of the axial piston pump is smaller than a value to be expected based on valve position, or the control unit detects that the system pressure present at the valve inlet is at a maximum without a delivery volume flow flowing in the direction of the hydraulic consumer.

12 Claims, 2 Drawing Sheets

(51) Int. Cl.

| | |
|---|---|
| ***F04B 49/06*** | (2006.01) |
| ***F04B 49/12*** | (2006.01) |
| ***F04B 49/00*** | (2006.01) |
| ***F04B 1/324*** | (2020.01) |
| ***F04B 49/22*** | (2006.01) |
| ***F15B 19/00*** | (2006.01) |
| ***F04B 49/10*** | (2006.01) |

(52) U.S. Cl.
CPC ..... *F04B 49/065* (2013.01); *F04B 49/12* (2013.01); *F04B 49/22* (2013.01); *F15B 19/005* (2013.01); *F04B 49/106* (2013.01)

(58) Field of Classification Search
CPC ..... F04B 49/08; F04B 49/106; F04B 49/12; F04B 49/123; F04B 49/22; F15B 19/005
See application file for complete search history.

(56) References Cited

U.S. PATENT DOCUMENTS 5,394,696 A * 3/1995 Eich ..... E02F 9/22 60/420
5,680,760 A * 10/1997 Lunzman ..... E02F 9/2228 60/426
5,701,933 A * 12/1997 Lunzman ..... E02F 9/2228 137/596.12
6,131,391 A * 10/2000 Poorman ..... E02F 9/123 60/448
6,179,570 B1 * 1/2001 Smith ..... F04B 49/002 417/212
6,446,433 B1 * 9/2002 Holt ..... F04B 49/065 60/433
6,874,318 B1 * 4/2005 MacLeod ..... F04B 49/08 60/451
7,089,733 B1 * 8/2006 Jackson ..... F15B 11/165 60/422
8,435,010 B2 * 5/2013 Dybing ..... F15B 11/0406 417/222.1
8,607,559 B2 * 12/2013 Dybing ..... F15B 11/0423 60/468
9,086,143 B2 * 7/2015 Nelson ..... F16H 61/433
9,759,212 B2 * 9/2017 Lingenfelter ..... F04B 49/065
10,215,170 B2 * 2/2019 Rill ..... F04B 19/22
10,539,162 B2 * 1/2020 Horii ..... E02F 9/2225
2006/0198736 A1 * 9/2006 Rousseau ..... E02F 9/2235 417/53
2010/0154403 A1 * 6/2010 Brickner ..... E02F 9/2235 60/452
2015/0136251 A1 * 5/2015 Knapper ..... F15B 13/06 137/565.11
2016/0363117 A1 * 12/2016 Ligenfelter ..... F04B 49/12
2017/0254308 A1 * 9/2017 Mast ..... F15B 11/165
2018/0058482 A1 * 3/2018 Carpenter ..... E02F 9/268

* cited by examiner

METHOD FOR OPERATING A HYDRAULIC CONSUMER ON AN ELECTRICALLY ACTUATED CONTROL VALVE

RELATED APPLICATIONS

This application claims priority to German Patent Application Ser. No. 102018212077.3, filed Jul. 19, 2018, the disclosure of which is hereby incorporated by reference in its entirety.

FIELD OF THE DISCLOSURE

The present disclosure relates to a method for operating a hydraulic consumer on an electrically actuated control valve which, in an open valve position, establishes a connection between a valve inlet and a pilot line connected to a control connection for influencing a pivot angle, which can be set on an axial piston pump and which provides a system pressure, which is present at the valve inlet and is dependent on the pivot angle.

BACKGROUND

Hydraulic consumers are used, for example, in agricultural implements or accessories for carrying out a very wide variety of working functions, where the implements or accessories are connected to a control valve block on an agricultural tractor via associated hydraulic hoses. The control valve block consists of a plurality of electrically actuated control valves, each of which has a first and second hydraulic connection which acts as a supply or return for connecting a respective hydraulic consumer. In order to put the hydraulic consumer into operation, the valve position of the control valve can be adjusted as desired on the operator side via an operating terminal provided in the agricultural tractor.

In practice, it has been found that most operators initially move the control valve into a completely open valve position, which has the effect that the axial piston pump is pivoted to full output via the pilot line. In the case of certain hydraulic consumers, this has the consequence that the delivery volume flow supplied by the axial piston pump is too high and has to be throttled later. This applies, among others, to hydraulic consumers designed as hydraulic rotary drives.

In addition, there are hydraulic consumers in which, due to their basic design, there is no (significant) delivery volume flow during operation, so that the system pressure built up by the axial piston pump unnecessarily assumes a maximum value as a result of the resulting hydraulic back pressure. These include, in particular, hydraulic consumers designed as hydraulic linear controllers. Therefore, undesired hydraulic power losses may occur in both types of consumers.

Thus, there is a need for a method that allows a reliable detection of undesired hydraulic power losses during the operation of a hydraulic consumer.

SUMMARY

In the present disclosure, a method is provided for operating a hydraulic consumer on an electrically actuated control valve which, in an open valve position, establishes a connection between a valve inlet and a pilot line connected to a control connection for influencing a pivot angle which can be set on an axial piston pump and which provides a system pressure which is present at the valve inlet and is dependent on the pivot angle. Sensor-acquired information with respect to the current system pressure and the current pivot angle of the axial piston pump is sent to a control unit so as to deduce, when the hydraulic consumer is connected, an incorrect setting (i) of the control valve when the control unit detects that a delivery volume flow of the axial piston pump resulting from the current pivot angle is less than a value to be expected on the basis of the position of the control valve; (ii) of the system pressure when the control unit detects that the system pressure applied to the valve inlet is maximum without a delivery volume flow toward the hydraulic consumer.

The two different approaches reflect two different types of consumers. The first type of consumer according to (i) generally concerns hydraulic rotary drives with continuous hydraulic consumption, whereas the second type of consumer according to (ii) typically includes hydraulic linear controllers with a more or less limited positioning travel.

The method in this disclosure makes it possible to reliably detect an incorrect setting leading to corresponding hydraulic power losses in each of the two types of consumers and to remedy this by initiating suitable countermeasures.

Operator information indicating the incorrect setting is output via a display terminal connected to the control unit. The operator information may include indications of the type of incorrect setting or of the affected hydraulic consumer as well as recommendations or instructions for initiating suitable countermeasures.

With regard to the first type of consumer, it can be provided for initiating suitable countermeasures that if an incorrect setting of the control valve is detected, the valve position is adjusted by the control unit to match the delivery volume flow resulting from the current pivot angle of the axial piston pump. The pivot angle is detected by means of a rotary controller, the angle information of which is sent to the control unit for evaluation, for example, via a CAN data bus. In this case, the control valve is closed until the value of the delivery volume flow to be expected on the basis of the position of the control valve coincides with the (actual) delivery volume flow resulting from the respective pivot angle. The need for subsequent throttling, including the associated hydraulic power losses, can accordingly be avoided.

The control unit can easily recognize if the value of the delivery volume flow at the control valve corresponding to the current pivot angle has been reached on the basis of a drop in rotational speed occurring at the hydraulic consumer with further closing. The rotational speed is available, for example, on an ISOBUS data network which communicates with the agricultural implement and via which rotational speed information of a rotational speed sensor assigned to the hydraulic consumer is transmitted to the control unit.

The associated valve position can then be stored in a memory connected to the control unit, so that it is available when the same hydraulic consumer is reconnected and need not be determined again.

With respect to the second type of consumer, it can be provided for the initiation of suitable countermeasures that an overpressure valve that can be adjusted with respect to a pressure threshold value is disposed on the control valve between the pilot line and the valve outlet, the pressure threshold value being reduced by the control unit in accordance with a specific pressure requirement of the hydraulic consumer if an incorrect setting of the system pressure is detected. These control valves equipped with an adjustable pressure relief valve are available as standard items, so that the implementation of such a function is readily possible.

In the simplest case, the specific pressure requirement can be specified as a fixed value and stored in a memory unit connected to the control unit. It is conceivable here that the associated pressure threshold value can be set by the operator by selecting the agricultural implement that is to be operated from an implement database via an operator terminal connected to the control unit. An immediate input of the pressure threshold (usually unknown to the operator) is therefore unnecessary. In a departure therefrom, the agricultural implement that is to be operated can be selected from the implement database on the basis of an implement identifier transmitted to the control unit via an ISOBUS data network or via RFID data transmission. In addition, a transmission of the pressure threshold value to be set is also basically possible. Generally speaking, there is the possibility that the specific pressure requirement or corresponding information from the hydraulic consumer is communicated to the control unit via a data network communicating with the control unit.

It is also conceivable for the specific pressure requirement to be determined by the control unit on the basis of an operating pressure drop occurring at the hydraulic consumer and stored in a memory unit connected to the control unit with the assignment of an identifier of the hydraulic consumer, so that the identifier is available for reuse at a later point in time. This procedure is particularly suitable for agricultural implements with hydraulic consumers for which a specific pressure requirement cannot be called up by selection from an implement database and is thus unknown. The implement database can then be completed with the determined specific pressure requirement with regard to the agricultural implement. The operating pressure is available, for example, on an ISOBUS data network that communicates with the agricultural implement and via which operating pressure information from an operating pressure sensor associated with the hydraulic consumer is transmitted to the control unit.

In the case of both types of consumers (i) or (ii), it is possible for the adjustment of the valve position or the reduction of the pressure threshold value to be carried out automatically by the control unit after prior release by an operator via an operator terminal connected to the control unit. The latter ensures that the operator of the agricultural tractor is at all times aware of the operating state of the agricultural implement or of the hydraulic consumer affected by the automated adjustment process.

Alternatively, the adjustment of the valve position or the reduction of the pressure threshold value can also be carried out manually via an operator terminal connected to the control unit, so that the operator has full control over the adjustment process at all times.

In order to simplify or support the manual adjustment process, it is conceivable for the operator to receive a feedback via a display terminal connected to the control unit as soon as the valve position corresponds to the delivery volume flow of the axial piston pump resulting from the current pivot angle or the system pressure present at the valve inlet corresponds with the specific pressure requirement of the hydraulic consumer.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
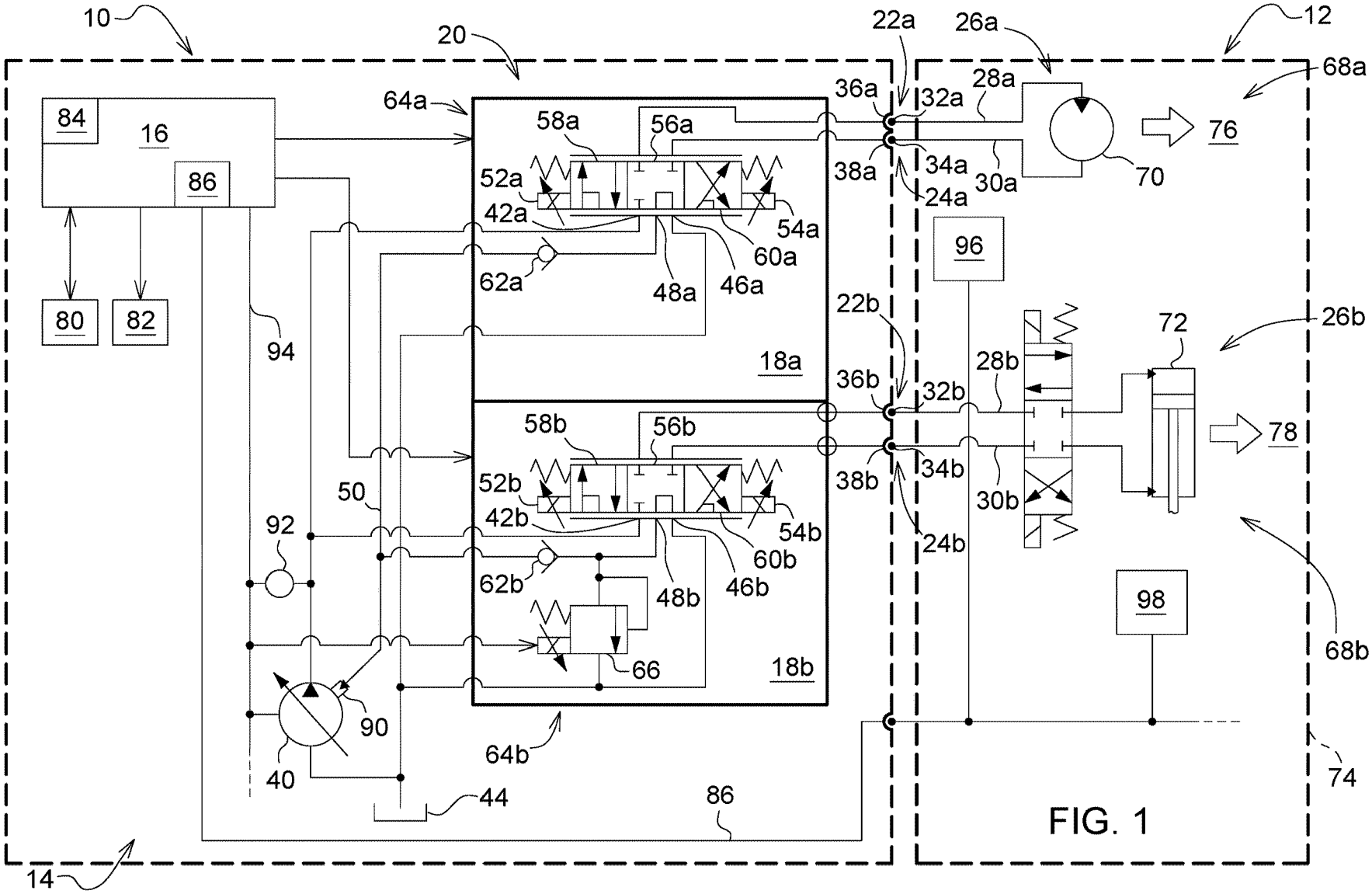
FIG. 1 shows an arrangement for carrying out a method for operating a hydraulic consumer on an electrically actuated control valve.

FIG. 1 shows an arrangement that comprises a utility vehicle for carrying out a method for operating a hydraulic consumer on an electrically actuated control valve. The utility vehicle (not shown in detail) is an agricultural tractor 10 on which an agricultural implement or accessory 12 is attached on a coupling device located in a rear or front region. The coupling device is made, for example, as a three-point hitch or as a drawbar or coupling jaw. According to FIG. 1, the assembly 14 includes a microprocessor-controlled control unit 16 and a control valve block 20 comprising a plurality of electrically actuated control valves 18*a*, 18*b*. Typically, up to eight control valves are combined in a common control valve block 20, but in the present case only two are shown for clarity. Each of the control valves 18*a*, 18*b* has a supply or return in the form of first hydraulic connections 22*a*, 22*b* and second hydraulic connections 24*a*, 24*b* for operating a respective hydraulic consumer 26*a*, 26*b* of the agricultural implement 12. The connection is made via hydraulic hoses 28*a*, 28*b*, 30*a*, 30*b*, which communicate with the hydraulic consumers 26*a*, 26*b* and at the open ends of which are mounted hydraulic couplers 32*a*, 32*b*, 34*a*, 34*b*, which can be detachably connected to a respective coupling socket 36*a*, 36*b*, 38*a*, 38*b* of the respective control valve 18*a*, 18*b*.

Furthermore, a valve inlet 42*a*, 42*b* connected to an axial piston pump 40 and a valve outlet 46*a*, 46*b* opening into a hydraulic sump 44 are provided on each of the control valves 18*a*, 18*b*. A pilot line 50 connected to a control connection 48*a*, 48*b* of the control valve 18*a*, 18*b* serves to influence an adjustable pivot angle $\alpha$ at the axial piston pump 40, so that a system pressure $p_{sys}$ dependent on the pivot angle $\alpha$ is provided at the valve inlet 42*a*, 42*b*.

The control valves 18*a*, 18*b* can be moved by associated solenoids 52*a*, 54*a*, 52*b*, 54*b* against a restoring spring force from a closed valve position 56*a*, 56*b* into a first open valve position 58*a*, 58*b* or a second open valve position 60*a*, 60*b*, wherein the positions differ with respect to the direction of the hydraulic flow to the hydraulic consumer 26*a*, 26*a*. The function of the first and second hydraulic connections 22*a*, 22*b*, 24*a*, 24*b* as supply and return, respectively, can therefore be reversed depending on the opening direction of the control valve 18*a*, 18*b*. At the same time, when the control valve 18*a*, 18*b* is opened, a connection is established between the valve inlet 42*a*, 42*b* and the pilot line 50 communicating with the control connection 48*a*, 48*b*. The control pressure present at the control connection 48*a*, 48*b* or the pilot line 50 results from the degree of opening of the control valve 18*a*, 18*b* and assumes the system pressure $p_{sys}$ present at the valve inlet 42*a*, 42*b* when it is completely open. Check valves 62*a*, 62*b* connected downstream of the control connections 48*a*, 48*b* ensure that, on the side of the control valves 18*a*, 18*b*, the highest of the control pressures in each case is present at the pilot line 50 leading to the axial piston pump 40.

Two different control valve types 64*a*, 64*b* are shown by way of example in FIG. 1. The first control valve type 64*a* is of conventional construction, whereas the second control valve type 64*b* has a pressure relief valve 66, which is adjustable with respect to a pressure threshold value and is disposed between the pilot line 50 and the valve outlet 46*a*, 46*b*. The two control valve types 64*a*, 64*b* may be present in any combination in the control valve block 20.

Two different types of consumers 68*a*, 68*b* are connected to each of the two representative control valve types 64*a*, 64*b*. The first consumer type 68*a* is a hydraulic rotary drive 70 with continuous hydraulic consumption, whereas the second consumer type 68*b* is a hydraulic linear controller 72. For illustrative purposes only, the two hydraulic consumers 26*a*, 26*b* are intended to be part of an agricultural implement 12 designed as a seeder 74 and serve there to drive a blower 76 or to actuate a ground pressure control that is part of a row seeding unit 78.

With regard to the method of the present disclosure, the operation of the first consumer type 68*a* is compatible with both control valve types 64*a*, 64*b*, while the operation of the second consumer type 68*b* necessarily requires the second control valve type 64*b*.

In order to put the hydraulic consumers 26*a*, 26*b* on the agricultural implement 12 or the working functions associated with them into operation, the valve position of each control valve 18*a*, 18*b* can be set by the operator via an operating terminal 80 provided in the agricultural tractor 10.

As can be seen in FIG. 1, in addition to the operating terminal 80, the control unit 16 is also connected to a display terminal 82, a memory unit 84, a data interface 88 communicating with an ISOBUS data network 86 of the agricultural implement 12, a rotary controller 90 for detecting the pivot angle $\alpha$ set at the axial piston pump 40 and a pressure sensor 92 for detecting the system pressure $p_{sys}$ present at the valve inlets 42*a*, 42*b*. The angle information of the rotary controller 90 is supplied to the control unit 16 together with the system pressure information provided by the pressure sensor 92 via a CAN data bus 94 of the agricultural tractor 10 for evaluation. In addition, rotational speed information of a rotational speed sensor 96 assigned to the hydraulic rotary drive 70 and operating pressure information of an operating pressure sensor 98 assigned to the hydraulic linear controller 72 are transmitted via the ISOBUS data network 86, which information reflects the operating pressure present on the input side of the hydraulic linear controller 72. In addition, an individual implement identifier of the connected agricultural implement 12 is transmitted to the control unit 16 via the ISOBUS data network 86.

The display terminal 82 is either designed as a unit separate from the operating terminal 80 or combined with the operating terminal 80 in the form of a touch-sensitive screen.

For the sake of completeness, it should be pointed out that the arrangement 14 described above can equally well also be a component of a construction or forestry machine or of any other desired commercial vehicle. In this respect, the method is not limited to a specific vehicle environment or application.

Figure 2:
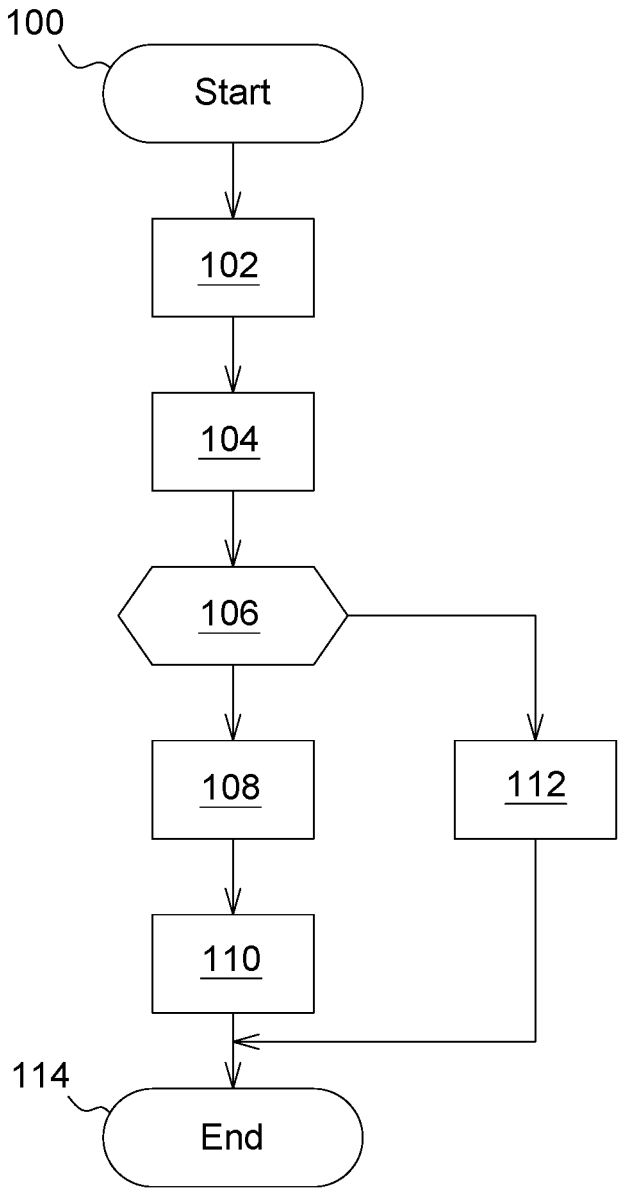
FIG. 2 is a flow chart illustrating the method of FIG. 1.

FIG. 2 shows an embodiment of the method in a flow chart. The method is initiated with the starting of the agricultural tractor 10 in a start step 100. In a first step 102, information obtained by sensors regarding the current system pressure $p_{sys}$ and the current pivot angle $\alpha$ of the axial piston pump 40 is sent to the control unit 16 via the CAN data bus 94. In a second step 104, the information is used by the control unit 16 to infer a possible incorrect setting of the first control valve 18*a* or the system pressure $p_{sys}$ generated by the axial piston pump 40. There are different procedures for this depending on the connected consumer type 68*a*, 68*b*.

(i) Incorrect Setting of the First Control Valve (First Consumer Type)

On the one hand, the control unit 16 concludes in the second step 104 that the first control valve 18*a* is incorrectly adjusted if it detects that a delivery volume flow of the axial piston pump 40 resulting from the current pivot angle $\alpha$ is smaller than a value to be expected on the basis of the valve position of the first control valve 18*a*. The latter is derived by the control unit 16 from the control current flowing for actuating the respective solenoid 52*a*, 54*a*, for which the control unit uses a control curve stored in the memory unit 84 for the first control valve 18*a*.

(ii) Incorrect Setting of System Pressure (Second Consumer Type)

On the other hand, in the second step 104, the control unit 16 concludes that the system pressure $p_{sys}$ is incorrectly set if it is detected by the control unit that the system pressure $p_{sys}$ present at the valve inlets 42*a*, 42*b* is at maximum without a (significant) delivery volume flow from the second control valve 18*b* flowing in the direction of the hydraulic linear controller 72.

If one of the two conditions (i) and (ii) mentioned above applies, then, in a third step 106, operator information indicating an incorrect setting is output via the display terminal 82 connected to the control unit 16. The operator information contains indications of the type of incorrect setting and/or of the affected hydraulic consumer 26*a*, 26*b*, as well as recommendations or instructions for the initiation of suitable countermeasures. These are illustrated below.

(i) Countermeasures for the First Type of Consumer

With regard to the first consumer type 68*a*, it is provided in a fourth step 108 for initiating suitable countermeasures that, in the event of a detected incorrect setting of the first control valve 18*a*, the valve position is adjusted by the control unit 16 (either at the prior initiation of the operator or automatically) to the delivery volume flow resulting from the current pivot angle $\alpha$ of the axial piston pump 40. In this case, the first control valve 18*a* is closed by the control unit 16 until the value of the delivery volume flow to be expected on the basis of the valve position of the first control valve 18*a* matches the (actual) delivery volume flow of the axial piston pump 40 resulting from the respective pivot angle $\alpha$ within predetermined tolerances.

Whether the value of the delivery volume flow corresponding to the current swivel angle $\alpha$ is set at the first control valve 18*a* is detected by the control unit 16 in the fourth step 108 due to a speed drop occurring at the further closing of the hydraulic rotary drive 70, for which purpose the speed information transmitted via the ISOBUS data network 86 of the rotational speed sensor 96 associated with the hydraulic rotary drive 70 can be evaluated by the control unit 16. The first control valve 18*a* is then opened again just to such an extent that the observed speed drop does not yet occur.

The associated valve position is then stored in a fifth step 110 in the memory unit 84 connected to the control unit 16, so that it is available when the same hydraulic rotary drive 70 or the agricultural implement 12 comprising is reconnected and need not be determined again.

(ii) Countermeasures for the Second Type of Consumer

With regard to the second consumer type 68*a*, it is provided in a sixth step 112 for initiating suitable countermeasures that, in the event of a detected incorrect setting of the system pressure $p_{sys}$, the pressure threshold value of the pressure relief valve 66 is reduced by the control unit 16 in correspondence with a specific pressure requirement of the hydraulic linear controller 72.

In the simplest case, the specific pressure requirement of the respective hydraulic consumer 26*b* (in this case the hydraulic linear controller 72) is predetermined and stored in the memory unit 84 connected to the control unit 16. The associated pressure threshold value is selected by the operator by selecting the agricultural implement 12 to be operated from an implement database via the operator terminal 80 connected to the control unit 16. Alternatively, the agricultural implement 12 to be operated is selected from the implement database using the implement identifier 86 transmitted via the ISOBUS data network.

If such information is not available, the specific pressure requirement is determined by the control unit 16 in the sixth step 112 on the basis of an operating pressure drop occurring at the hydraulic linear controller 72 and stored in the memory unit 84 connected to the control unit 16 with assignment of an identifier of the hydraulic linear controller 72, so that the pressure requirement is available for reuse at a later point in time. For this purpose, the control unit 16 evaluates the operating pressure information of the operating pressure sensor 98 associated with the hydraulic linear controller 72, which is transmitted via the ISOBUS data network 86. This procedure is particularly suitable for agricultural implements with hydraulic consumers for which a specific pressure requirement cannot be called up by selection from an implement database and is thus unknown.

Regardless of the respective consumer type 68*a*, 68*b*, it is possible that the adjustment of the valve position or the reduction of the pressure threshold value by the control unit 16 in the sixth step 112 will be carried out automatically after prior release by the operator via the operator terminal 80 connected to the control unit 16.

Alternatively, the adjustment of the valve position or the reduction of the pressure threshold value in the sixth step 112 is carried out manually by the operator via the operator terminal 80 connected to the control unit 16. In order to simplify or support the manual adjustment process, the operator receives feedback via the display terminal 82 connected to the control unit 16 as soon as the valve position corresponds to the delivery volume flow of the axial piston pump 40 resulting from the current pivot angle $\alpha$ or the system pressure $p_{sys}$ present at the valve inlets 42*a*, 42*b* corresponds to the specific pressure requirement of the respective hydraulic consumer 26*a*, 26*b* within predetermined tolerances. Subsequently, the method is terminated in a final step 114.

The method makes it possible to reliably detect an incorrect setting leading to corresponding hydraulic power losses in each of the two types of consumer 68*a*, 68*b* and to remedy this by introducing suitable countermeasures.

While exemplary embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A method for operating a hydraulic consumer with an electrically actuated control valve, comprising:
   - providing the control valve with an open valve position establishing a connection between a valve inlet and a pilot line connected to a control connection for influencing a pivot angle which is set on an axial piston pump and that provides a system pressure which is present at the valve inlet and is dependent on the pivot angle;
   - detecting data by one or more sensors with respect to the current system pressure and the current pivot angle of the axial piston pump;
   - communicating the data to a control unit;
   - determining when the hydraulic consumer is connected to the control valve;
   - determining an incorrect setting of the system pressure if the control unit detects that the system pressure present at the valve inlet is at a maximum without a delivery volume flow flowing in the direction of the hydraulic consumer;
   - positioning an overpressure valve that is set with respect to a pressure threshold value on the control valve between the pilot line and the valve outlet; and
   - in the event of a detected incorrect setting of the system pressure, reducing the pressure threshold value via the control unit in accordance with a specific pressure requirement of the hydraulic consumer.

2. The method of claim 1, further comprising outputting operator information indicating at least one of the incorrect setting of the control valve and the incorrect setting of the system pressure via a display terminal connected to the control unit.

3. The method of claim 1, wherein the specific pressure requirement is predetermined and stored in a memory unit connected to the control unit.

4. The method of claim 1, further comprising reporting the specific pressure requirement or corresponding information from the hydraulic consumer to the control unit via a data network communicating with the control unit.

5. The method of claim 1, further comprising:
   - determining the specific pressure requirement via the control unit on the basis of an operating pressure drop occurring at the hydraulic consumer; and
   - storing the specific pressure requirement for later reuse in an accumulator unit connected to the control unit with assignment of an identifier of the relevant hydraulic consumer.

6. The method of claim 1, further comprising carrying out the adjustment of the valve position or the reduction of the pressure threshold value automatically by via the control unit after prior release by an operator via an operator terminal connected to the control unit.

7. The method of claim 1, further comprising carrying out the adjustment of the valve position or the reduction of the pressure threshold value manually via an operating terminal connected to the control unit.

8. The method of claim 7, further comprising providing feedback via a display terminal connected to the control unit as soon as the valve position corresponds to the delivery volume flow of the axial piston pump resulting from the current pivot angle or the system pressure present at the valve inlet corresponds to the specific pressure requirement of the hydraulic consumer.

9. A method for operating a hydraulic consumer with an electrically actuated control valve, comprising:

controlling via a control unit the control valve to an open valve position establishing a first connection between a valve inlet and a pilot line connected to a control connection for influencing a pivot angle which is set on an axial piston pump and that provides a system pressure which is present at the valve inlet and is dependent on the pivot angle, the open valve position establishing a connection between the axial piston pump and the hydraulic consumer;

controlling via the control unit the control valve to a closed valve position establishing a second connection between the valve inlet and the pilot line connected to the control connection for influencing the pivot angle which is set on the axial piston pump that provides the system pressure which is present at the valve inlet and is dependent on the pivot angle, the closed valve position closing the connection between the axial piston pump and the hydraulic consumer;

detecting data by one or more sensors with respect to the system pressure and the pivot angle of the axial piston pump;

communicating the data to the control unit;

determining when the hydraulic consumer is connected to the control valve;

determining an incorrect setting of the control valve if the control unit detects that a delivery volume flow of the axial piston pump resulting from the pivot angle is smaller than a value to be expected on the basis of the valve position of the control valve; and in the event of a detected incorrect setting of the control valve, closing the valve position via the control unit until the hydraulic consumer drops in speed as sensed via a rotational speed sensor connected to the control unit.

10. The method of claim 9, further comprising:

controlling via the control unit the control valve to a second open valve position reversing the flow between the control valve and the hydraulic consumer.

11. The method of claim 9, further comprising outputting operator information indicating the incorrect setting of the control valve via a display terminal connected to the control unit.

12. The method of claim 9, further comprising storing the valve position in a memory unit connected to the control unit.

* * * * *